United States Patent [19]

Cummings

[11] 4,266,687

[45] May 12, 1981

[54] SEALING COVER AND METHOD FOR RESEALING AN INTRAVENOUS CONTAINER

[75] Inventor: Robert Cummings, Richardson, Tex.

[73] Assignee: U.S. Clinical Products, Inc., Richardson, Tex.

[21] Appl. No.: 125,988

[22] Filed: Feb. 29, 1980

[51] Int. Cl.[3] ..... B65D 51/20; B65D 39/00; B65D 41/00

[52] U.S. Cl. ..... 220/257; 220/270; 220/359; 215/232; 215/249; 215/247; 215/251; 229/43; 128/272

[58] Field of Search ..... 220/214, 257, 270, 359; 215/232, 247, 249, 251; 229/43; 128/272, 764

[56] References Cited

U.S. PATENT DOCUMENTS

| | | | |
|---|---|---|---|
| 1,916,977 | 7/1933 | Gutmann | 215/232 |
| 3,391,847 | 7/1968 | Christine et al. | 220/257 X |
| 3,463,339 | 8/1969 | McGuckin | 215/247 |
| 3,712,498 | 1/1973 | Lawrence | 215/247 |
| 4,131,211 | 12/1978 | Corbic | 215/232 X |
| 4,209,126 | 6/1980 | Elias | 215/232 X |

*Primary Examiner*—George T. Hall

*Attorney, Agent, or Firm*—Richards, Harris & Medlock

[57] ABSTRACT

A laminated self-destructing sealing cover (10) has a container cover area (14) and pull tab (16). Protrusions (18) extend from the outer edge of the cover area (14) to promote proper use of the cover (10). A slit (20) may be into the protrusion (18) or the outer edge of the cover area (14) to promote tearing of the cover upon removal of a container. The bottom side of the cover (10) engaging the container top is a central disk (24) surrounded by an annular ring of adhesive material (28). Adhesive material (28) is self destructed upon removal of the cover (10) from the container to leave a telltale ring (28A) on the container top. In an alternate embodiment, an area of perforations (60) may be made in the area of the cover (10) for engaging the container top to leave a telltale trace of the cover on a container top upon removal of the cover (10).

26 Claims, 7 Drawing Figures

SEALING COVER AND METHOD FOR RESEALING AN INTRAVENOUS CONTAINER

TECHNICAL FIELD

This invention relates to an apparatus and method for resealing a sterilized intravenous container, and more particularly to a sterile seal for resealing the container after the original seal is broken and for leaving a tell-tale mark on the metal rim of the container top when the seal is removed.

BACKGROUND ART

Intravenous (I.V.) additive programs are administered in many hospitals as one method for introducing medications into a patient. In prescribing such a treatment program, a doctor may prescribe any one of the number of drugs or vitamins which are to be added to an I.V. bottle and administered intravenously to his patient. The amount of the drug must also be prescribed by the doctor to adjust the dosage of medicine added to the intravenous solution to each particular patient. In addition, I.V. additive programs may include a combination of I.V. additive solutions in a "piggyback" arrangement of containers for certain specialized treatment through a combination of drugs.

In a hospital's I.V. additive program, the prescribed medication is added to an I.V. bottle under sterilized conditions by inserting a needle into the "target area" rubber membrane closing the top of an I.V. solution bottle. The I.V. solution bottle has a sterile seal covering the membrane area until the medication is to be added. The I.V. container must then be resealed under sterilized conditions to prevent airborne bacteria, such as *Pseudomonas Aeruginosa,* from accumulating on the exposed upper surface of the I.V. container top. In addition, resealing the container alerts the hospital staff that the contents have been altered by the pharmacy. The hospital's nursing staff will not administer the I.V. solution unless they mix the contents, or there is some means to alert the nursing staff that the contents have not been altered since prepared by the pharmacy.

The prior practice has been to utilize a plastic cap for resealing the I.V. containers. The plastic caps snap over the top of the metal rim surrounding the rubber membrane to completely seal the top of the solution bottle. In an effort to hold down hospital costs and reduce expensive inventory space, the current practice at most hospitals is to attempt to maintain only one size of plastic cap in inventory. Since the I.V. solution and piggy back containers manufactured by different manufacturers have tops which are not of uniform diameter, the plastic caps do not always provide the necessary sterilized seal in resealing the I.V. container. Further, because of the tight fit required between the plastic cap and the metal rim, the nursing staff often remove the caps by using expensive surgical instruments or scissors which can be damaged. It is standard practice at some hospitals to adminster pliers to remove the caps. The problem of removing the plastic caps results in the inefficient use of the time of skilled personnel, such as registered nurses, attempting to remove such container closures. More importantly, the present prior art closures and method for resealing I.V. solution bottles would not allow a nurse inspecting a container without a sealing cover to know where it was removed or if it was previously resealed. In such a situation, rather than risk exposing the patient to a serious infection from harmful bacteria which may have accumulated on top of such a container, the nurse must often reject this container, which results in wasting the medication as well as wasting time in reordering another I.V. additive solution from the pharmacy.

DISCLOSURE OF THE INVENTION

The apparatus and method of the present invention is an improvement over the above-described prior art apparatus and method for resealing I.V. solution containers and alerting the staff that the contents have been altered in the pharmacy. In the present invention, an effective seal is provided from a combination of materials and bonding systems to form an improved seal which provides a sterile seal for an I.V. solution container and "piggyback" containers while maintaining the rubber membrane "target area" of the container sterile until the seal is removed. The laminated construction of sealing materials and bonding systems results in a flexible seal which may be packaged on a specially coated carrier liner, substantially reducing the inventory space required by the hospital for storing such closures.

The laminated structure of the improved sealing cover and method for resealing I.V. solution containers of the present invention includes a bacteria and moisture impermeable upper layer, such as polypropylene, as well as a sterilized non-adhesive surface to cover the rubber membrane "target area" of the container top. In addition, a self-destructing adhesive layer is included in the laminated structure, the adhesive layer being arranged to form an annular ring surrounding the circular "target area." The ring of adhesive material adheres tightly to the metal ring surrounding the rubber membrane "target area" and may be applied to the container with minimal pressure from the palm of the hand. A pull-tab is joined with the generally circular container cover for removing the sealing cover from the specially coated carrier liner, aligning it with its center over the "target area" of the container top, as well as removing the sealing cover from the container.

Another advantage of the sealing cover and method of resealing an I.V. container with the present invention is the layer of self-destructing adhesive material adhering to the metal rim of the top of the solution container. Any removal of the improved seal of the present invention from the container top leaves a tell-tale strip of material affixed to the metallic rim, which indicates to the nurse that the seal has been previously broken. The seal is self-destructing upon removal to prevent its reuse to seal another container. In addition, the presence of the tell-tale material on the rim of the cap reduces the chance of someone removing the seal, allowing the top to become contaminated and resealing the container with that seal or a new seal so that it would appear to hospital personnel to be in a sterilized condition.

In addition to the advantages stated above, the improved seal of the present invention may also have its upper polypropylene surface used as a coding area, e.g., for marking the type and quantity of the drug added to the I.V. solution.

DESCRIPTION OF THE PREFERRED EMBODIMENT

Figure 1:
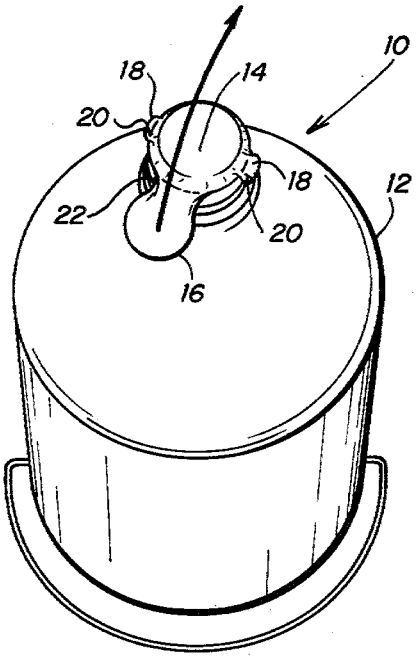
FIG. 1 is a perspective view of an I.V. solution container resealed with a seal of the present invention.

FIG. 1 illustrates the sealing cover of the present invention, generally identified by reference numeral 10, which is resealing the top of an I.V. solution container 12. The sealing cover 10 includes a generally circular cover area 14 with a pull-tab 16 attached to it for affixing and removing the cover 10. The cover area 14 also includes two protrusions 18 extending from opposite edges of the cover 14. The protrusions 18 have slits 20 cut part way through the length of the protrusions 18 in a direction that is generally perpendicular to the direction the pull-tab 16 is pulled in removing the cover 10 from the container 12. The direction the pull-tab is pulled is generally indicated by the direction arrow 22.

Figure 2:
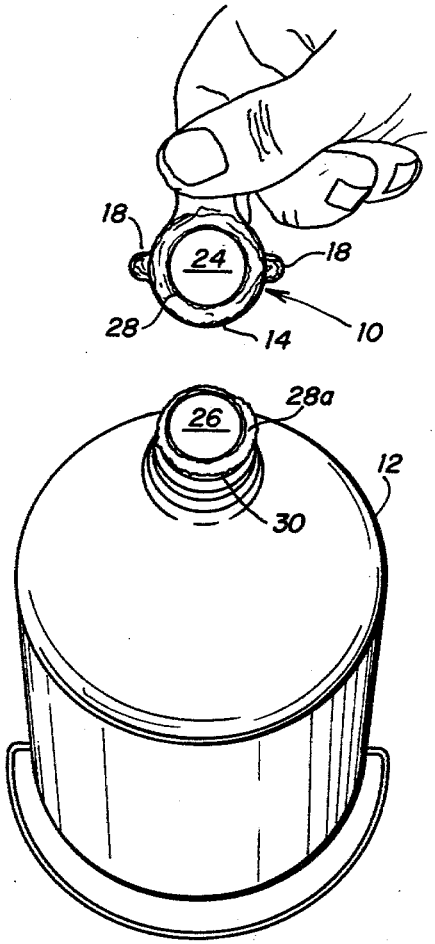
FIG. 2 is a perspective view of the I.V. solution container of FIG. 1 and illustrates the litho-destructible material adhering to the metal rim of the solution container top upon removal of the sealing cover.

FIG. 2 illustrates the I.V. solution container 12 and the sealing cover 10 of FIG. 1 after the cover 10 has been removed from the top of the container 12. FIG. 2 also illustrates the bottom side of the cover 10 which was in engagement with the top of the container 12 in FIG. 1. The bottom of the cover area 14 includes a generally circular disk 24, which covers the rubber membrane "target area" 26, of the container top 12. An annular ring 28 of lithodestructible material surrounds the disk 24 on the bottom side of the cover area 14.

A strip of the annular ring 28A adheres to the metal rim 30 of the top of the container 12 to visibly show that the sterile seal has been broken and to leave a layer of material around the rim 30 to prevent resealing with the same cover 10 since the seal destroys itself upon removal. The I.V. solution container 12 illustrated in FIG. 2 is now ready for a nurse to insert a needle through the rubber membrane "target area" 26, which has been kept sterile by the sealing cover 10, to administer the I.V. solution to the patient.

Figure 3:
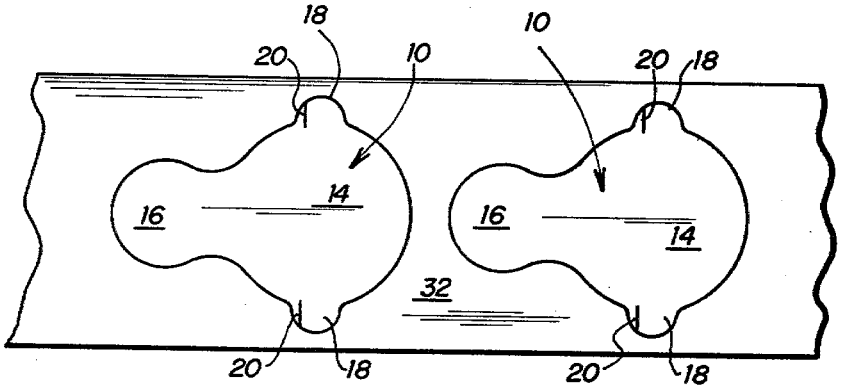
FIG. 3 is a top view of two sealing covers of the present invention packaged upon a strip of specially coated carrier liner.

FIG. 3 is a top view of two sealing covers 10 packaged upon a strip of carrier liner 32, which is coated with a special material to allow the adhesive annular ring 28 to adhere to the liner 32 for easy removal without destroying the litho-destructible adhesive layer. The cover 10 may be readily removed from the liner 32 by grasping the pull-tab area 16 which is not affixed to the carrier liner 32. The sealing covers 10 packaged upon a strip of the carrier liner 32 may be rolled and placed in a flat cardboard container for dispensing individual ones of the sealing covers 10. The improved sealing cover 10 of the present invention may be packaged on the carrier liners 32, which require only 10% of the storage space required for the molded plastic resealing caps of the prior art.

Figure 4:
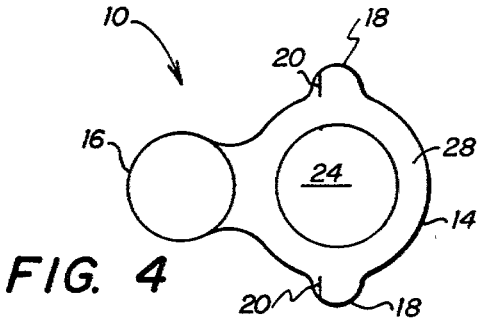
FIG. 4 is bottom view of the sealing cover of the present invention after its removal from the strip of specially coated carrier liner.

FIG. 4 is a bottom view of the sealing cover 10 as it might look after it has been removed from the carrier liner 32. The adhesive coating on the liner 32 is selected to form a seal tight enough to preserve the sterile seal when the liner 32 is rolled for packaging, but the adhesive does not adhere so tightly to the cover 10 as to cause it to self destruct upon removal from the liner 32. The sealing cover 10 may be grasped by hospital personnel with the pull-tab 16 without touching the disk 24 or the annular ring 28 which engaged the top of the container 12. Upon removal from the liner 32, the cover 10 may be held only by the pull-tab 16 for aligning the annular ring 28 of adhesive material directly over the metallic rim 30 of the top of the container 12, which positions the disk 24 on top of the rubber membrane 26. The cover 10 may then be securely affixed to a container 12, as it is shown in FIG. 1, by gently pressing down on the cover area 14 with the cupped palm of the hand, which causes the cover area 14, as well as the protrusions 18, to conform to and adhere to the metallic rim 30.

Figure 5:
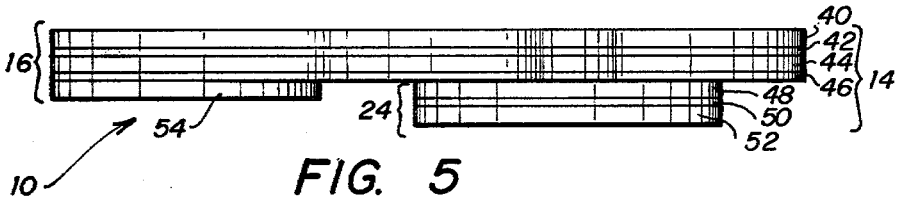
FIG. 5 is an enlarged side view illustrating the laminated construction of the preferred embodiment of the present invention.
Figure 6:
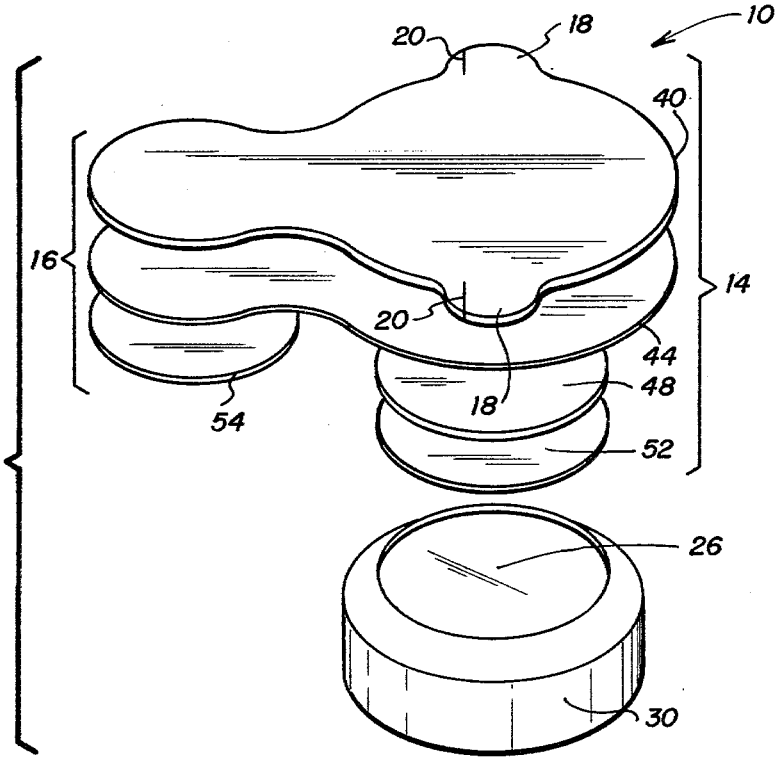
FIG. 6 is an enlarged exploded view of the laminated structure of the sealing cover of the present invention positioned above an I.V. solution container top.

FIGS. 5 and 6 illustrate the laminated structure of the preferred embodiment of the sealing cover 10. In this preferred embodiment of the sealing cover 10 a continuous strip of polypropylene is used to form a bacteria and moisture impermeable upper layer. The upper layer 40 is joined by an adhesive layer 42 to a continuous layer of litho-destructible material 44, which has a continuous strip of adhesive material 46 attached to it. Of course other self-destructible material may be used such as a vinyl or foil destructible material, in place of the litho-destructible material. The exposed surface of the adhesive material 46 is the surface of the annular rim 28, which attaches to the metal rim 30. The disk 24 of the bottom of sealing cover 10 consists of a layer of Kraft paper liner 48, a layer of adhesive material 50, and a final outer layer of polypropylene 52. The pull-tab area 16 also has a bottom layer of polypropylene 54 for providing a smooth non-adhesive surface for handling the sealing cover 10.

Of course, the sealing cover 10 of the present invention is not limited to the particular materials or arrangement of materials forming the laminated structure illustrated in FIGS. 5 and 6. The concept of the present invention may be implemented by the arrangement and selection of a number of materials and bonding systems to achieve the same overall effect of the improved sealing cover 10 of the present invention.

Figure 7:
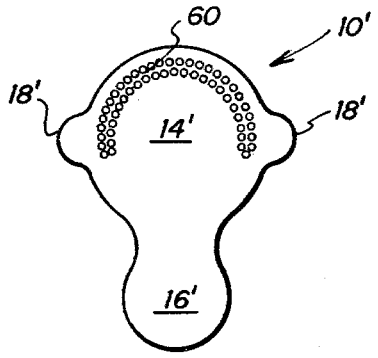
FIG. 7 is a top view of an alternate embodiment of the present invention.

One example of a sealing cover which is constructed differently from the preferred embodiment without departing from the overall concept or spirit of the present invention is sealing cover 10' illustrated in FIG. 7. Elements of the sealing cover 10' which correspond to similar elements of the preferred embodiment illustrated in FIGS. 1–6 are designated with the same numeral with the "'" designation.

The top layer of the sealing cover 10' may be contructed from polypropylene film or a similar material. The bottom side of the polypropylene film is coated with a layer of adhesive (not shown) upon which is fixed a disk 24' (not shown) which may be acetate film or a Kraft cover with acetate film. One of the principal differences between the sealing cover 10, illustrated in FIGS. 1–6 and described above, and sealing cover 10' of FIG. 7 is the method for providing a tell-tale sign to be left upon the metal rim 30 of the container 12. In sealing cover 10', there is no layer of litho-destructible material 44, but instead in seal 10' there are a number of perforations 60 through the polypropylene upper layer 40' arranged in such a pattern that will promote tearing upon removal of the cover 10'. One such suitable arrangement of perforations 60 has a generally half-moon shape oriented on the side of the cover area 14' opposite the pull-tab 16'. Of course other arrangements of the perforations may be selected instead of the half-moon shape as long as the arrangement of perforations acts to promote tearing or self-destruction of the seal cover 10'. While the protrusions 18' illustrated in FIG. 7 do not include slits 20, such slits could be added to promote tearing of the upper polypropylene film.

In use, the sealing cover 10 is manufactured under clean conditions and attached to a specially treated carrier liner 32 to retain the sterility of the cover 10. The strip of liner 32 is rolled and placed in a dispensing carton (not shown) and the cartons are packaged in plastic bags. The bags containing the packaged seals are then sterilized by using ethylene oxide gas to meet the current sterility standard of the U.S. Pharmacopoeia (U.S.P. No. 19). Of course the strip of carrier liner 32 with attached sealing covers 10 may be packaged in any suitable configuration for dispensing the sealing covers 10.

In a normal hospital I.V. additive program, the original sealing cover for the I.V. solution bottle installed by the manufacturer is removed by a nurse or other hospital personnel under hospital procedures prescribed for maintaining sterile conditions. Medication is then added to the I.V. solution bottle 12 under a sterile hood or similar hospital facility for maintaining a sterile work environment. The medication may be added to a full bottle or to a piggyback bottle, or a diluent may be added to a bottle to reconstitute a powdered drug. The rubber membrane 26 is punctured with a needle and a controlled quantity of the drug prescribed by the physician is released into the solution and the needle is withdrawn. One of the sealing covers 10 is then peeled from the special carrier liner 32 using the tab 16. The "target area" of the seal, the disk 24, remains sterile until removed from the carrier under normal working conditions. The disk 24 is aligned to interface with the "target area" of the container 12, the rubber membrane 26. This also aligns the annular ring 28 with the upper surface of the metal rim 30 of the container 12. The outer edge of the sealing cover 10 may be forced into contact with metal rim 30 by gentle pressure of the cupped palm of the hand to apply pressure to the outer edge of the ring 28 where adhesive is in contact with the rim. To insure a proper seal, the protrusions 18 on opposite edges of the cover area 16 should also be pressed against the metal rim 30. Only slight pressure of the hand is required to effect the proper seal. The pull tab 16 should also be pressed down so that the adhesive around the outer edge of the ring 28 contacts the metal rim 30. The sealing cover 10 may also include a code applied to the upper surface of the tab area 16 for indentification purposes. The coding information supplied may indicate the identity of the drug additive in the I.V. solution, or such other information as may be desired by the user.

The sterile seal of the resealed I.V. container 12 is not broken until the nurse is ready to administer the I.V. additive solution to the patient. The sealing cover 10 may be easily removed by hand without using pliers, scissors, or other instruments as are now often required in removing the plastic resealing caps now in use. The pull-tab 16 of the sealing cover 10 may be pulled upwards in the direction indicated by the arrow 22 of FIG. 1 in order to completely remove the cover from the container 12, as illustrated in FIG. 2. In utilizing the sealing cover 10 of the preferred embodiment, removal of the sealing cover 10 leaves a tell-tale annular ring 28A of adhesive paper to indicate that the sterile seal has been broken and to prevent resealing such a container. In using the sealing cover 10' of the alternate embodiment illustrated in FIG. 7, the tell-tale indicator that the sterile seal has been broken would be an area of polypropylene film adhering to the metal rim in the general configuration of the perforations 60 of the sealing cover 10'. A trace of material left on the metal rim alerts the hospital staff that the sterile seal has been removed. A second area to check integrity of the sterile seal is the inner circular disk 24 as it loosens from the body of the seal when removed from the I.V. container 12. Once the sealing cover 10 or 10' has been removed, the nurse proceeds normally to insert a needle through the "target area" rubber membrane 26 and completes the connection through the necessary plastic tubing to an intravenous catheter inserted into the patient.

Although the preferred embodiments of the invention have been illustrated in accompanying drawings described in the foregoing description, it will be understood that the invention is not limited to the embodiments disclosed, but is capable of numerous rearrangements, modifications and substitutions of parts and elements without departing from the spirit of the invention. Of course, the size and configuration of the cover area 14 and pull-tab 16 may be arranged to conform with any size or shape container top and with the area of the "target area" membrane 26 and metal rim 30 of any I.V. solution container 12 to be resealed. Further, the seal 10 may be used on any container top as a security seal. Whether or not the seal serves to maintain the sterility of a container, it may serve separately as a means for indicating if the container seal has been broken through use of its self-destructing characteristic upon removal.

I claim:

1. A sealing cover for providing a sterile cover to reseal the rubber membrane and surrounding metal rim of the top of an intravenous solution container, comprising:

a disk sized to substantially cover the area of the rubber membrane of the container top;

an annular ring surrounding said disk, said ring having a layer of adhesive material for adhering to the metal rim of the container cap as well as a layer of self-destructing material to leave a portion of said self destructing material adhering to the metal rim upon removal of the sealing cover; and an upper layer of material adhering to said annular ring forming an upper surface of the cover, said upper layer being formed from a material substantially impermeable to moisture and bacteria, whereby the sterility of the rubber membrane is retained by placing the sealing cover on the container top with the disk centered over the rubber membrane and the annular ring adhesively engaging the metal rim.

2. The sealing cover of claim 1 and further comprising:

a liner disposed between said disk and said annular ring, such that said liner substantially reduces the risk of adhesive material contaminating the rubber membrane of the the I.V. container by passing through said disk.

3. The sealing cover of claim 1 and further comprising at least one protrusion extending from the outer edge of said upper layer of the cover, whereby said protrusion promotes the attachment of the cover to the metal rim of the container.

4. The sealing cover of claim 3 wherein said protrusion includes a slit extending in a direction generally perpendicular to the direction the cover is pulled in peeling it from the top of the container, whereby said slit promotes tearing of said self-destructing material upon removal.

5. The sealing cover of claim 1 and further comprising:

a pull-tab connected to and extending from an outer edge of said upper layer of the sealing cover, whereby said pull-tab facilitates the orientation and placement of the cover upon the top of the I.V. container as well as facilitating the removal of the cover from the container.

6. The sealing cover of claim 5, wherein said pull-tab contains coded information relative to the I.V. solution to promote proper use of the solution within the container.

7. The sealing cover of claim 1, wherein said layer of self-destructing material is a layer of a litho-destructible material.

8. The sealing cover of claim 1, wherein said layer of self-destructing material is a layer of vinyl-destructible material.

9. The sealing cover of claim 1, wherein said layer of self-destructing material is a layer of foil-destructible material.

10. The sealing cover of claim 1, wherein said upper layer is polypropylene.

11. The sealing cover of claim 1, wherein said disk contacting the rubber membrane of the I.V. container is polypropylene.

12. The sealing cover of claim 1 and further comprising:

a strip of material for adhesively receiving said annular ring for packaging the cover prior to application to a container top, such that the sterility of the cover is retained until it is removed from said strip of material and applyied to cover of the top of the I.V. solution container.

13. The sealing cover of claim 1, wherein said liner is a layer of Kraft paper.

14. A laminated self-destructing sealing cover for providing a sterile seal for the rubber membrane and metal rim closure of the top of an I.V. solution container, comprising:

a first layer configured to substantially cover the area of the metal rim surrounding the rubber membrane, said first layer being substantially impermeable to moisture and bacteria;

a second layer of adhesive material applied to the bottom side of said first layer;

a third layer configured as a circular disk and attached to the bottom of said second layer, such that a generally annular area of the adhesive material of said second layer is exposed on the bottom side of said first layer for alignment with and adherence to the metal rim of the top; and an area of perforations extending through the annular ring of said first and second layers, whereby said disk may be aligned atop the rubber membrane and the annular area with the metal rim to form a sterile seal and said area of perforations promotes tearing of the upper layer upon removal of the cover from the top of solution container as evidence that the sterile seal has been broken.

15. The sealing cover of claim 14, wherein the disk of said third layer is formed from a plastic film and is chemically treated on the upper layer attached to said adhesive second layer to prevent the adhesive material from contaminating the rubber membrane.

16. The sealing cover of claim 14, wherein the disk of said third layer is a Kraft cover with an acetate film, said disk having its upper layer chemically treated to inhibit the adhesive material of said second layer from contaminating the upper surface of the rubber membrane.

17. The sealing cover of claim 14, wherein said perforations are arranged in a generally crescent-shaped area opposite the edge of said first layer to be peeled first from the surface of the metal rim.

18. The sealing cover of claim 14, and further comprising:

a pull-tab extending from and connected to the outer edge of said first layer for facilitating alignment and attachment of the sealing cover to the metal rim, as well as to facilitate removal of the sealing cover from the metal rim of the top of the I.V. solution container.

19. The sealing cover of claim 14 and further comprising:

at least one protrusion extending from the outer edge of said first layer of the sealing cover to promote attachment of the cover to the metal rim.

20. The sealing cover of claim 14, wherein said first layer is formed from a polypropylene film.

21. The sealing cover of claim 14 and further comprising:

a strip of packaging material for attaching said second layer of adhesive material for maintaining the cover in a sterile condition until the cover is removed from said material.

22. A method of resealing the top of an intravenous solution bottle to maintain the sterility of the rubber membrane surface attached with a metal rim to the top of the bottle, comprising:

forming a first layer of a material that is generally impervious to moisture and airborne bacteria to substantially cover the rubber membrane;

disposing a second layer of adhesive material atop said first layer, said second layer extending beyond the outer edges of said first layer to form an annular area of adhesive material for engaging the metal rim of the I.V. solution bottle top;

disposing a third layer of material atop said second layer of adhesive material, said third layer of material being substantially impermeable to moisture and airborne bacteria;

joining said first, second, and third layers of material to form an integral laminated structure for use as a sealing cover;

attaching said laminated cover to a strip of carrier liner;

sterilizing the laminated cover and the carrier liner and packaging the cover and liner to maintain sterility prior to use; and removing the cover from the liner and applying the cover to the top of the bottle with said second layer of adhesive material in contact with the metal rim of the top of the bottle.

23. The method of sealing an intravenous solution bottle of claim 22 and further comprising:

forming a pull-tab for the sealing cover for use in aligning the disk shaped area of said first layer over the area of the rubber membrane, as well as for removing the cover from the container.

24. The method of sealing an intravenous solution bottle of claim 22 and further comprising:

placing a layer of self-destructible material between said third layer and said second adhesive layer such that a portion of said layer of self-destructible material remains attached to the metal rim of a container upon removal of the sealing cover as evidence the sterile seal has been broken, as well as to prevent reusing the seal.

25. The method of sealing an intravenous solution bottle of claim 22 and further comprising:

cutting at least one slit through the outer edge of said third layer for promoting tearing of said third layer after removal of the sealing cover.

26. The method of sealing an intravenous solution bottle of claim 22 and further comprising:

perforating an area of said third layer and said second layer for promoting tearing of the third layer upon removal of the sealing cover to leave a portion of the third layer in engagement with the metal rim upon removal of the seal cover as an indication the sterile seal has been broken.

* * * * *

UNITED STATES PATENT AND TRADEMARK OFFICE

CERTIFICATE OF CORRECTION

PATENT NO. : 4,266,687

DATED : May 12, 1981

INVENTOR(S) : Robert Cummings

It is certified that error appears in the above—identified patent and that said Letters Patent is hereby corrected as shown below:

Column 4, line 33, change "rim" to --ring--.

Signed and Sealed this

*First* Day of *September 1981*

[SEAL]

*Attest:*

GERALD J. MOSSINGHOFF

*Attesting Officer*

*Commissioner of Patents and Trademarks*